US010772441B1

(12) United States Patent
Schoenfellinger

(10) Patent No.: US 10,772,441 B1
(45) Date of Patent: Sep. 15, 2020

(54) MULTI-LEVEL RISER DISPLAY AND STORAGE SYSTEM

(71) Applicant: Dietz & Watson Inc., Philadelphia, PA (US)

(72) Inventor: John Michael Schoenfellinger, Holland, PA (US)

(73) Assignee: Dietz & Watson Inc., Philadelphia, PA (US)

( * ) Notice: Subject to any disclaimer, the term of this patent is extended or adjusted under 35 U.S.C. 154(b) by 0 days.

(21) Appl. No.: 15/999,151

(22) Filed: Aug. 16, 2018

Related U.S. Application Data

(60) Provisional application No. 62/546,280, filed on Aug. 16, 2017.

(51) Int. Cl.
*A47F 3/00* (2006.01)
*A47F 3/06* (2006.01)
*A47F 3/04* (2006.01)

(52) U.S. Cl.
CPC ..... *A47F 3/063* (2013.01); *A47F 3/004* (2013.01); *A47F 3/007* (2013.01); *A47F 3/0426* (2013.01); *A47F 3/0482* (2013.01)

(58) Field of Classification Search
CPC .. A47F 3/00; A47F 3/06; A47F 5/0018; A47F 7/145; A47B 53/00
USPC ..... 312/114, 116–119, 122, 126, 128, 287, 312/249.9, 249.11–249.13
See application file for complete search history.

(56) References Cited

U.S. PATENT DOCUMENTS 398,605 A * 2/1889 Ganter
408,517 A * 8/1889 Pifferling
676,157 A * 6/1901 Sparks
1,226,027 A * 5/1917 Taussis ..... A47F 3/06 312/122
1,261,455 A * 4/1918 Stallings ..... A47F 3/00 312/119
1,430,921 A * 10/1922 Morton ..... A47F 3/00 312/118
1,955,370 A * 4/1934 Snook ..... A47F 5/0018 312/119
2,129,396 A * 9/1938 Archer ..... A47F 5/0018 312/234
2,614,017 A * 10/1952 Joachim ..... A47B 17/036 312/196
3,179,479 A * 4/1965 Freedman ..... A47F 7/145 312/140.3
3,256,709 A 6/1966 Stepleton
3,399,784 A 9/1968 Buchbinder et al.
3,489,474 A * 1/1970 Domenico ..... A47F 3/06 312/119
4,026,616 A * 5/1977 Kuehl ..... A47B 77/02 312/249.9
4,285,558 A * 8/1981 Medford ..... G11B 23/0236 211/55

(Continued)

*Primary Examiner* — Janet M Wilkens
(74) *Attorney, Agent, or Firm* — Boyle Fredrickson, S.C.

(57) ABSTRACT

A food product display and storage system configured for use in a deli-style refrigerated display case is provided. The system includes a shelf unit configured to retain food products, having at least one shelf and an outwardly extending frame. The outwardly extending frame receives an edge of the rear surface of a display riser such that the shelf unit is received partially within an interior recess of the display riser.

17 Claims, 8 Drawing Sheets

(56) References Cited

U.S. PATENT DOCUMENTS

| | | | | | |
|---|---|---|---|---|---|
| 4,667,822 | A | * | 5/1987 | Coopmans | B25H 3/04 206/223 |
| 5,496,103 | A | * | 3/1996 | Kozak | A47F 3/005 312/116 |
| 5,606,863 | A | | 3/1997 | Kicklighter et al. | |
| 5,671,987 | A | * | 9/1997 | Hommes | A47B 88/42 312/234.5 |
| 5,738,019 | A | | 4/1998 | Parker | |
| 5,964,512 | A | * | 10/1999 | Borgen | A47F 7/0078 312/116 |
| 6,560,842 | B1 | | 5/2003 | Kusel et al. | |
| 7,121,104 | B2 | | 10/2006 | Howington et al. | |

* cited by examiner

MULTI-LEVEL RISER DISPLAY AND STORAGE SYSTEM

CROSS-REFERENCE TO RELATED APPLICATION

This application claims the benefit of U.S. Ser. No. 62/546,280 filed Aug. 16, 2017, the disclosure of which is incorporated herein in its entirety.

BACKGROUND OF THE INVENTION

1. Field of the Invention

This invention relates to a display and storage system configured for use in a deli-style display case, and more particularly to a front facing multi-level riser display with an integrated slidable storage unit extending from behind and in-part below the riser display.

2. Background

In the display of perishable food products, such as deli meats and cheeses or other items, it is desirable to allow potential customers to view the bulk or unsliced food products. The display of such bulk items allows for the presentation of wrapped and/or packaged products that clearly display the product itself and various advertising labels to the customer, where they are most effective. Additionally, the bulk items provide a more orderly and esthetically pleasing presentation to the customers. However, whole bulk deli meats and cheeses are often relatively large products, with relatively large footprints. Accordingly, the display of such products has been known to occupy a large portion of the relatively small space available in a deli-style refrigerated display case.

Therefore, prior attempts have been made to limit the amount of space utilized by such displays in deli-style refrigerated display cases. Such attempts have included the use of integrated shelves within the display case. However, in such cases, the whole bulk deli meats and cheeses are simply placed towards the front of the glass display case, and the opened and partially sliced food products are placed towards the rear of the display case. Such a solution is undesirable as the opened and partially sliced food products remain visible to the customers and may detract from the desired esthetics of the deli case display.

Alternatively, removable multi-level displays formed of generally solid surfaces have also been used. Such displays are preferable in that the solid surface nature of their construction allows the opened and partially sliced food products to be placed behind the multi-level displays where they are kept out of sight to the customers. However, such solutions do not provide for an improved organization of the food products located behind the multi-level displays, nor do they provide a means for improved storage thereof.

Accordingly, there is currently a desire for a system for use in deli-style refrigerated display case that provides both a front facing multi-level riser display and an integrated slidable storage extending from behind and underneath the riser display.

BRIEF DESCRIPTION OF THE INVENTION

By way of nonlimiting summary, in accordance with one aspect, the present invention contemplates a display and storage system configured for use in a deli-style refrigerated display case including a display riser with a series of shelves configured to retain food products thereon, and a shelf unit that extends into a recess within the display riser.

In one embodiment of the present invention, the series of shelves of the display riser may include at least a first shelf at a first height and a second shelf at a second height greater than the first height.

In another embodiment of the present invention, the slidable shelf unit may include at least one slidable shelf configured to retain food products therein, wherein that at least one slidable shelf is movable between a first position adjacent the display riser and a second position rearward of the first position.

In yet another embodiment of the present invention, the shelf unit may include an outwardly extending frame that defines a slot for receiving an edge of the rear side, such that the display riser is releasably affixed to the shelf unit and the shelf unit extends in-part into the interior recess of the display riser.

In yet another embodiment of the present invention, the outwardly extending frame may be disposed at an angle such that when the edge of the rear side of the display riser is received therein the display riser is tilted between 10° and 20° relative to a generally horizontal surface that the supports the system.

These and other features and aspects of the present invention will be better appreciated and understood when considered in conjunction with the following description and the accompanying drawings. It should be understood, however, that the following description, while indicating representative embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
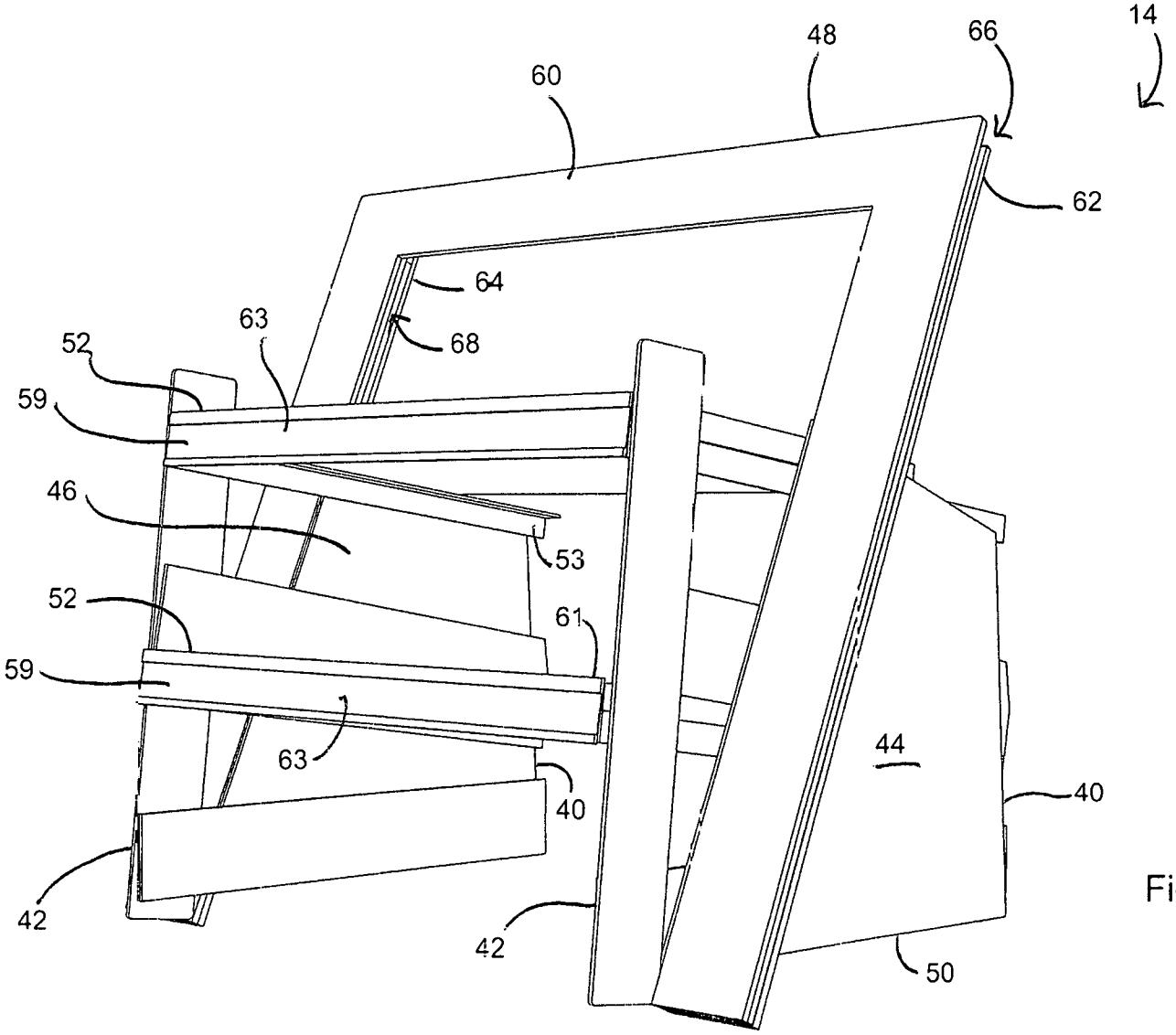
FIG. 1 is a rear and left-side perspective view of a shelving unit in accordance with one embodiment of the present invention that is configured to receive a multi-level shelf riser.

In describing the embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word "connected," "attached," or terms similar thereto are often used. They are not limited to direct connection, but include connection through other elements where such connection is recognized as being equivalent by those skilled in the art.

DETAILED DESCRIPTION

The various features and advantageous details of the subject matter disclosed herein are explained more fully with reference to the non-limiting embodiment described in detail in the following description.

Figure 2:
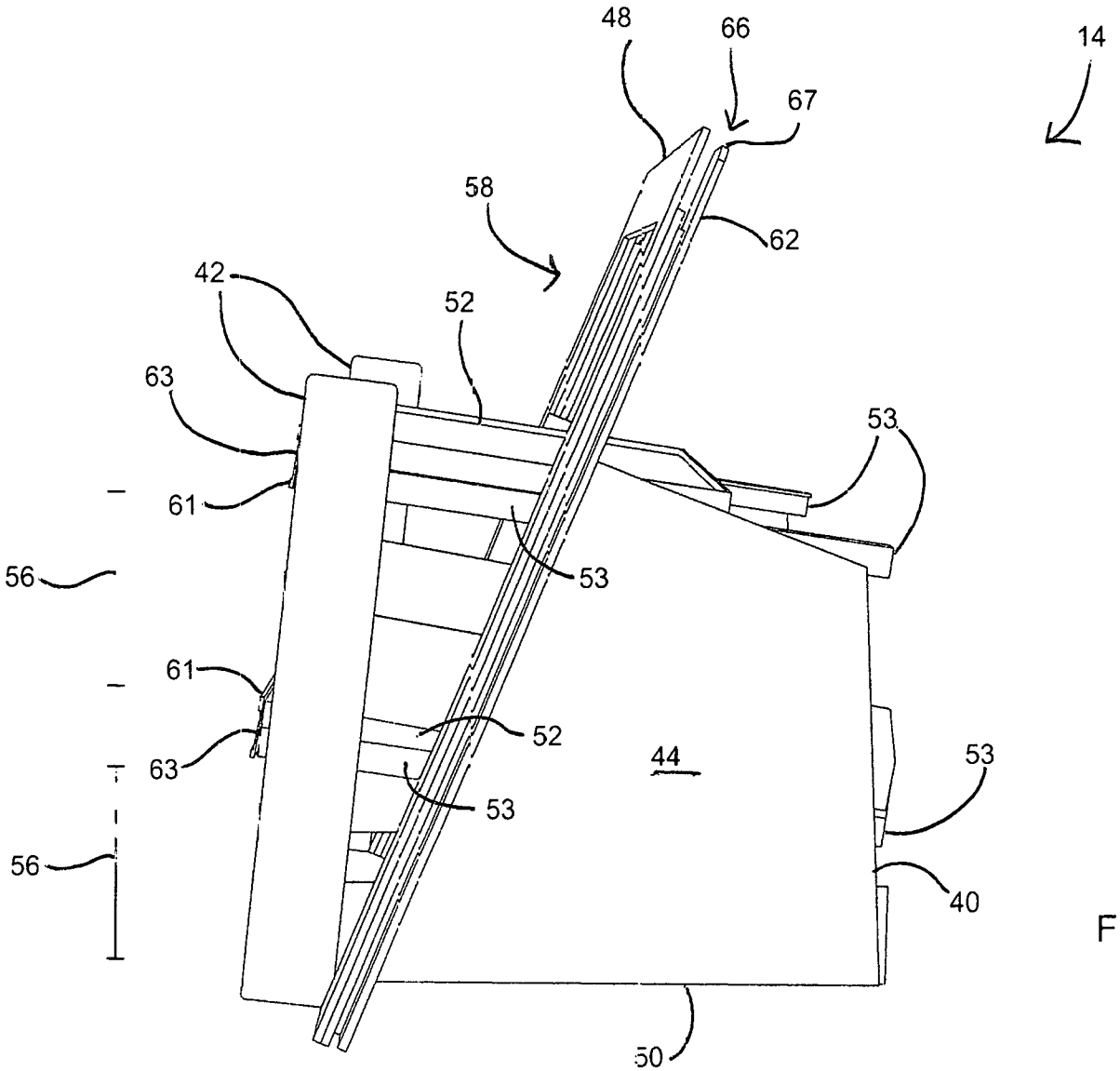
FIG. 2 is a left side perspective view of the shelving unit of FIG. 1.
Figure 3:
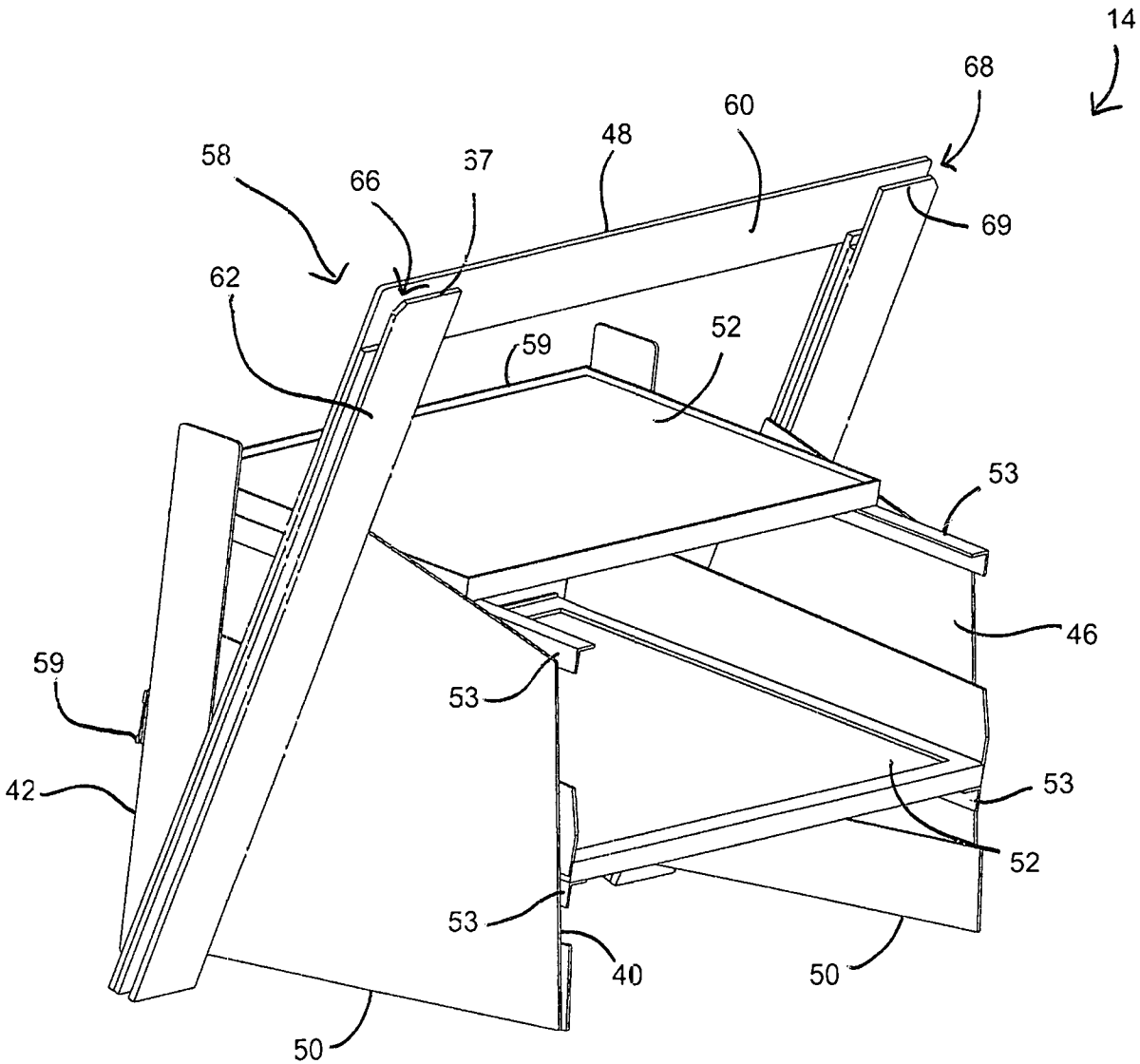
FIG. 3 is front left-side perspective view of the shelving unit of FIG. 1.
Figure 4:
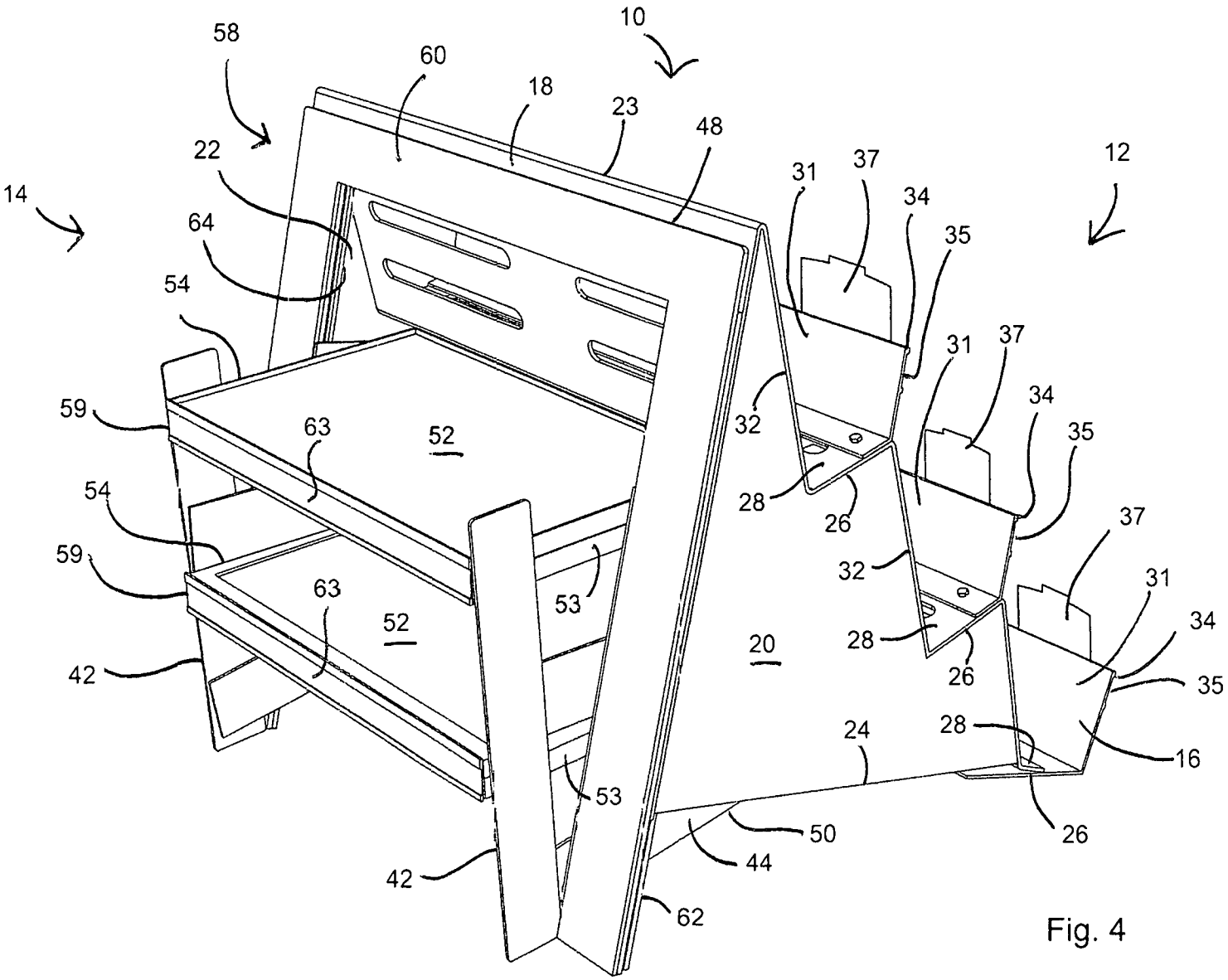
FIG. 4 is a rear, top, and left-side perspective view of the shelving unit of FIG. 1 receiving a multi-level shelf riser to from a display and storage system in accordance with one embodiment of the present invention.

Referring to FIGS. 1-8, and initially FIGS. 4-8, a representative display and storage system 10 is shown in accordance with one embodiment of the present invention. As shown in FIG. 4, the system 10 includes a multi-level display riser 12 and a shelving unit, i.e., slidable or fixed shelving unit 14, where the slidable or fixed shelving unit 14 is configured to be received behind and in-part beneath the multi-level display riser 12. The system 10 is preferably formed primarily of a food grade rigid plastic material, such a high-density polyethylene, and metal fasteners, but may be formed of any other food grade material such as aluminum or stainless steel.

Figure 5:
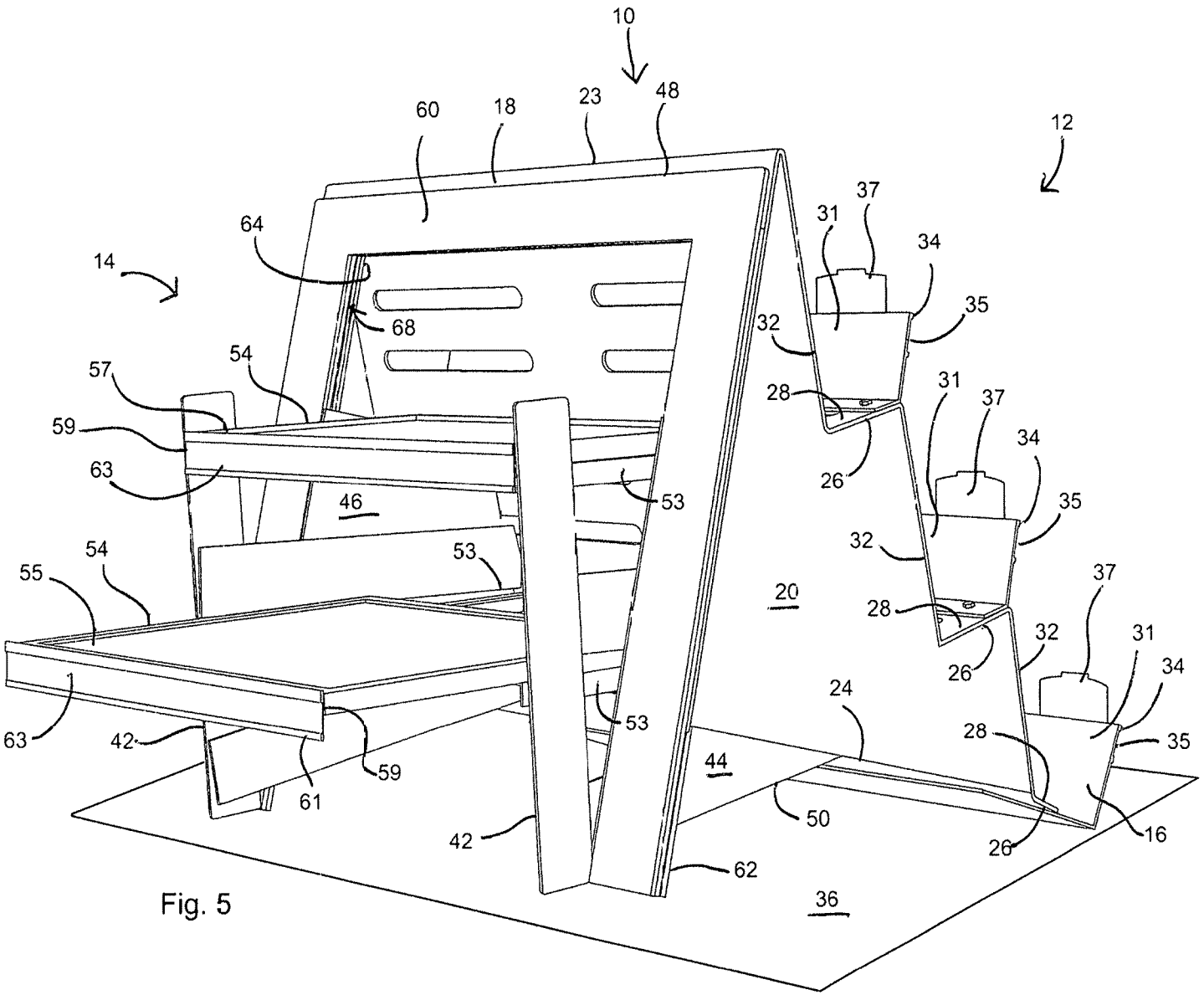
FIG. 5 is a rear and left-side perspective view of the display and storage system of FIG. 4, in which one slidable shelf unit has been extended rearwardly.
Figure 6:
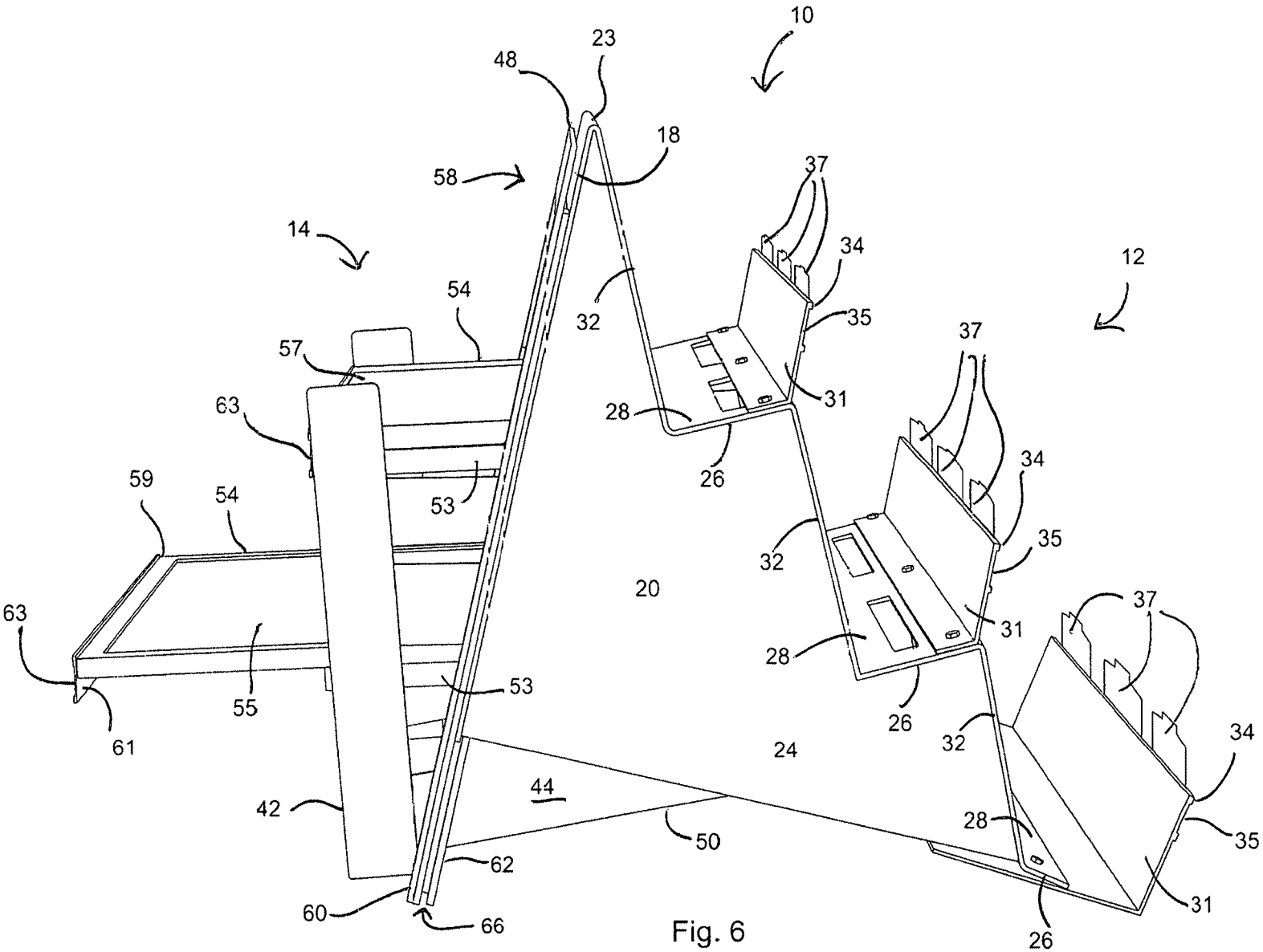
FIG. 6 is a left-side perspective view of the display and storage system of FIG. 5.
Figure 7:
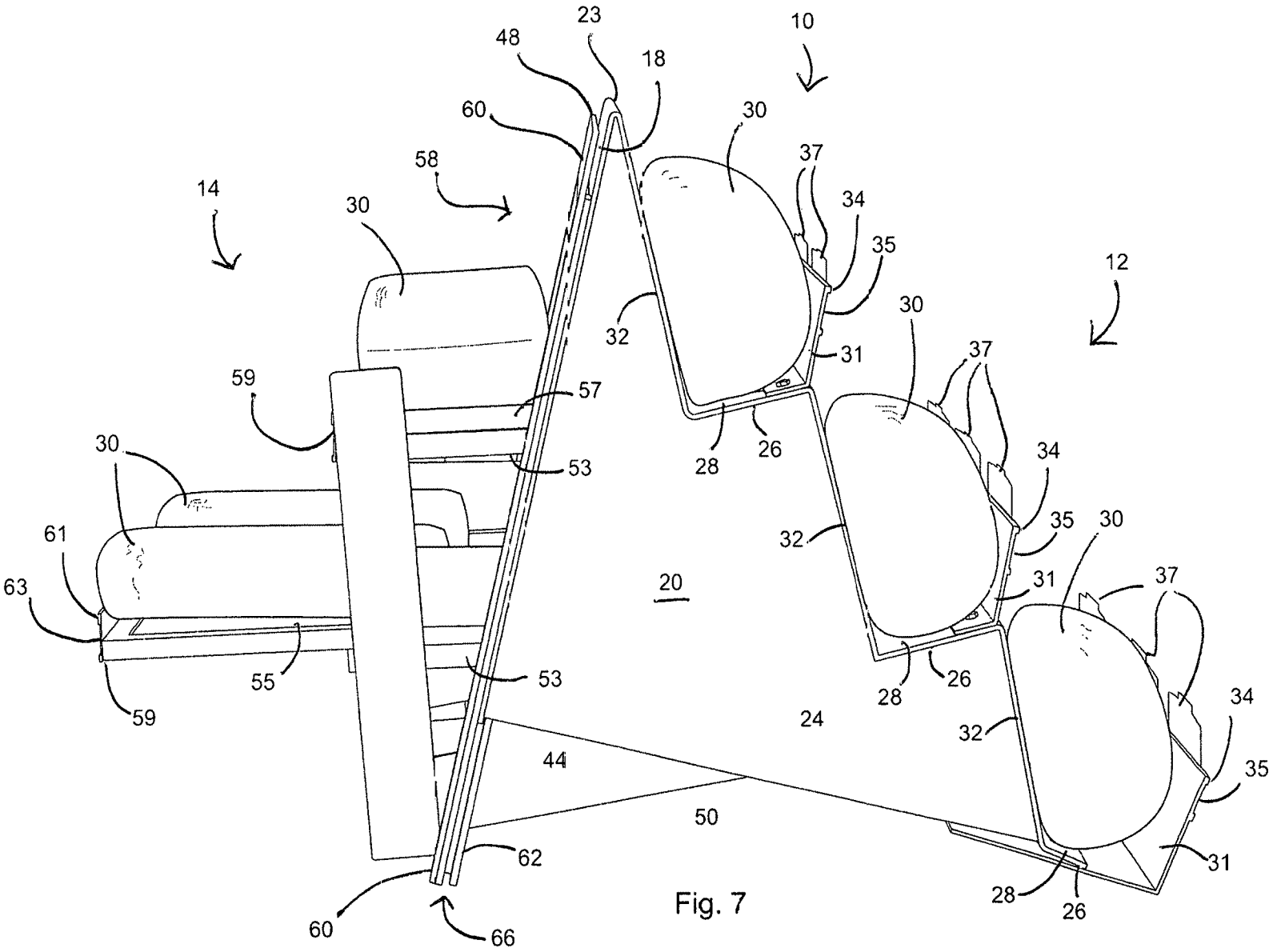
FIG. 7 is a left-side perspective view of the display and storage system of FIG. 6, including various food products arranged in both storage and display locations; and, FIG. 8 is a rear perspective view of the display and storage system of FIG. 6, in which the slidable shelf unit has been extended forwardly into a storage position located beneath a portion of the multi-shelf riser.

Still referring to FIGS. 4-8, the riser 12 includes a front 16, a rear 18, a first side 20, an opposing second side 22, a top 23 and a bottom 24. A series of shelves 26 may be disposed within the front 16 of the riser 12 in a step-like fashion. In one embodiment, each of the shelves 26 has a shelf surface 28 with a depth sufficient to receive and retain one or more perishable food products 30, such as deli meats and cheeses, therein, as shown in FIG. 7. The shelves 26 preferably are also spaced apart at a height 32 sufficient as to allow the shelf 26 of perishable food products 30 to be displayed without interference from the products 30 displayed on the adjacent shelf 26. A retention tab 31 and label support 34, as shown in FIGS. 4-7, may also extend from the front end of each shelf 26. The retention tab 31 extends upwardly from the front end of each shelf and is configured to prevent the food products 30 from falling forward, off of the shelf 26. Preferably the height of the retention tab 31 is limited as to prevent obscuring or substantially covering the advertising labels of the various displayed products 30. Furthermore, the front facing surface of the retention tab 31 defines a label support 34, which may include a track 35 disposed therein for receiving one or more labels 37, as shown in FIGS. 4-7. The labels 37 may be slidably positionable along the length of the track 35 as to be placed adjacent corresponding perishable food products 30 as shown in FIG. 7. Each individual label 37 may include corresponding information related to the adjacently located perishable food product 30 including but not limited to manufacturer information, product identification information, and/or pricing information. While the multi-level display riser 12 is shown in FIGS. 4-8 in one configuration of the present invention having three shelves 26, it should be understood that the present invention is not so limited, and any number of shelves 26 may be considered within the scope of the present invention.

As shown in FIGS. 4-8, the rear 18 of the multi-level display riser 12 may engage the slidable or fixed shelving unit 14, when the system 10 is assembled, as will be described in further detail below. As shown in FIG. 7, when the multi-level display riser 12 engages the slidable or fixed shelving unit 14, the rear 18 of the multi-level display riser 12 may pivot upwardly relative to the front 16 of the multi-level display riser 12, resulting in the bottom 24 being positioned at an angle relative to the base 36 upon which the system 10 is supported. By way of tilting the display riser 12, its occupies less area on the base 36, thereby providing additional space to accommodate the shelving unit 14 on the base 36. This is particularly relevant when the base 36 is a refrigerated deli-style display case in which the available surface area of the base 36 is limited. As a result of engaging the slidable or fixed shelving unit 14 in this manner, the multi-level display riser 12 may tilt forward when the multi-level display riser 12 engages the slidable or fixed shelving unit 14. However, in a representative embodiment as shown in FIGS. 4-7, the bottom support surface 28 of one or more shelves 26 of the multi-level display riser 12 may maintain a horizontal or generally rearwardly sloping surface while engaging the shelving unit 14, as to prevent the displayed food products 30 from becoming dislodged or undesirably falling forward during use.

As shown in FIG. 4-8, the slidable or fixed shelving unit 14 is illustrated as extending rearwardly from the behind and in-part below the rear 18 of the multi-level display riser 12. In this configuration a portion of the slidable or fixed shelving unit 14 is contained in part within an interior void or recess formed generally below and at the rear of the display riser 12.

Turning now to FIGS. 1-3, the slidable or fixed shelving unit 14 is shown independently, without the multi-level display riser 12. The slidable or fixed shelving unit 14 includes a front 40, a rear 42, a first side 44, an opposing second side 46, a top 48, and a bottom 50. A series of shelves 52 may be disposed within the interior of the slidable or fixed shelving unit 14, extending between the first and second sides 44, 46, respectively, along shelf tracks 53 that are located along the interior surfaces of the first and second sides 44, 46, respectively. In one embodiment, one or more of the shelves 52 are rearwardly slidable shelves 55, such that when extended, as shown in part in FIGS. 6 and 7, the one or more slidable shelves 55 extend rearwardly, past the rear 42 of the slidable or fixed shelving unit 14. In this embodiment, the slidable shelf 55 may move along the upper surface of the tracks 53, which are affixed to the shelving unit 14. When recessed, or pushed in, such as when in a storage position, the slidable shelves 55 may be disposed generally between the front 40 and rear 42 of the slidable or fixed shelving unit 14. In one representative embodiment of the present invention, such as shown in FIGS. 6 and 7, a lower shelf 52 may be a rearwardly slidable shelf 55, while the upper shelf 52 is a fixed location shelf 51. The fixed location shelf 57 may be attached directly to its corresponding tracks 53, as opposed to a slidable engagement present in slidable shelf 55. In this configuration, the rearwardly slidable shelf 55 will provide access to the greater surface area provided by the lower shelf 52, when the lower slidable shelf 55 has a greater surface area than the upper fixed location shelf 57.

Still referring to FIGS. 1-3, and particularly FIG. 1, the rear facing surface 59 of each shelf 52 defines a label support structure 61, which may include a track 63 disposed therein for receiving one or more product identification labels (not shown) similar to the labels 37 that are received in the tracks 35 of multi-level display riser 12 shown in FIGS. 4-7. The labels may be slidably positionable along the length of the track 63 as to be placed adjacent corresponding perishable food products 30 in order to facilitate organization of the perishable food products 30 on the shelves 52 and easily provide the grocery store or deli employee with product identification and pricing information.

Figure 8:
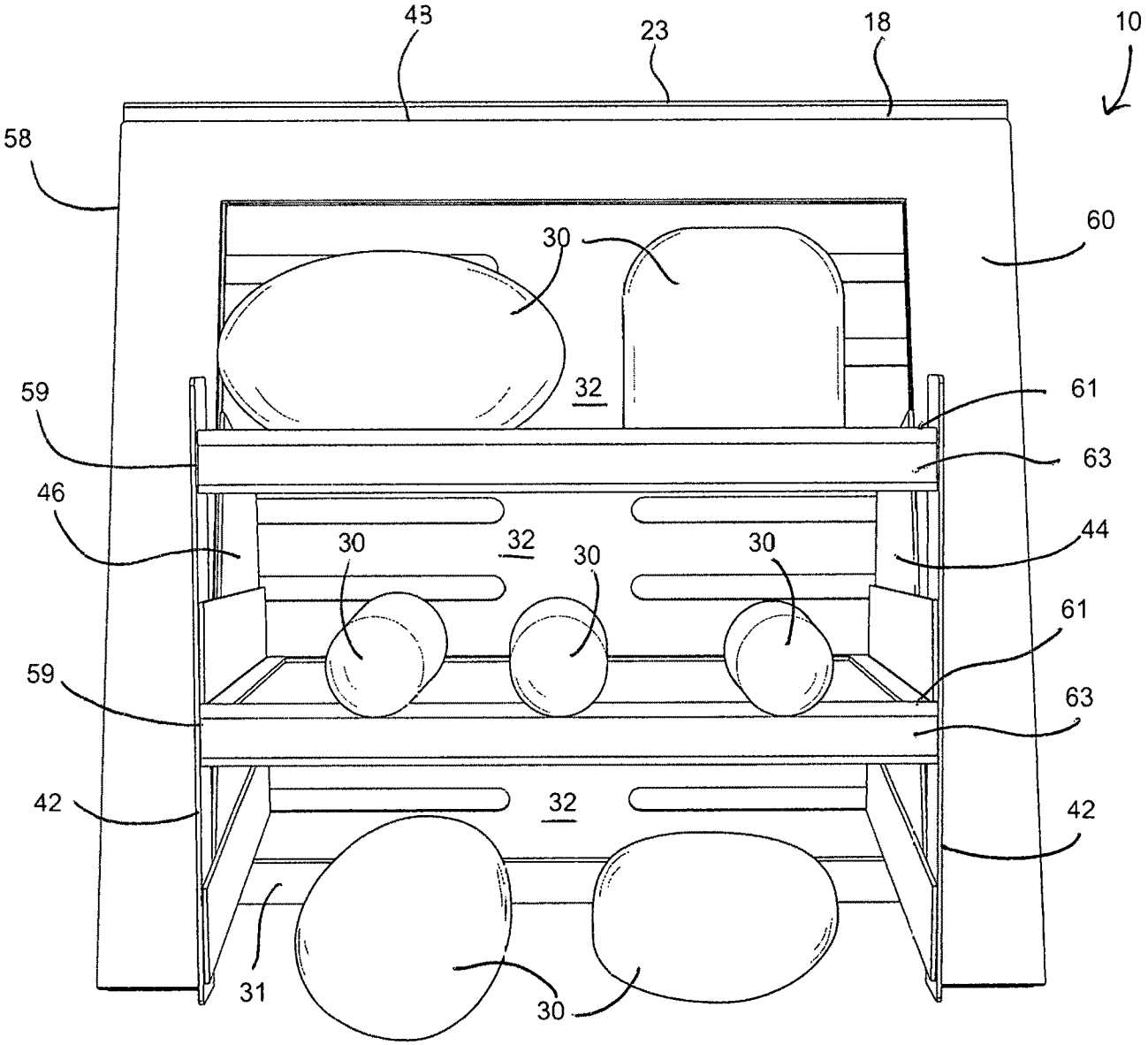

In one embodiment, each of the shelves 52 has a depth 54 defined by a length of the shelf 52 extending between the front 40 and rear 42 of the slidable or fixed shelving unit 14, as to maximize the surface area of the shelves 52 and increase the potential for storage of food products 30, as shown in FIGS. 7 and 8. The shelves 52 may be spaced apart at a height 56 sufficient as to allow the adjacent shelves 52 to store perishable food products 30 without interference or contact from the food products 30 stored on the adjacent shelf 52. While the slidable or fixed shelving unit 14 is shown in FIGS. 1-8, in one configuration of the present invention having one rearwardly slidable shelf 55 and one fixed location shelf 57, it should be understood that the present invention is not so limited, and any number of slidable shelves 55 or fixed shelves 57 may be considered within the scope of the present invention.

Returning now to FIGS. 1-3, and particularly FIG. 2, an outer frame 58 is shown extending outwardly along the outer surface of the first side 44, top 48 and second side 46 of the slidable or fixed shelving unit 14. The outer frame 58 forms a general "C" shape that extends outwardly along the sides 44, 46 and top 48 of the slidable or fixed shelving unit 14. In one embodiment of the present invention, the outer frame 58 may include a primary frame member 60, a first side frame member 62 and a second side frame member 64. As shown in FIGS. 1-3, the primary frame member 60 may extend along the outer surface of the first side 44, top 48 and second side 46 of the slidable or fixed shelving unit 14, and defines the rear facing surface of the outer frame 58 generally. The first side frame member 62 is located along the outer surface of the first side 44 of the slidable or fixed shelving unit 14, parallel to and slightly offset from the primary frame member 60. In this configuration a linear void, or slot 66, is formed between the primary frame member 60 and the first side frame member 62, which extends along the length of the first side frame member 62. Similarly, on the opposing side of the slidable or fixed shelving unit 14, the second side frame member 64 is located along the opposing outer surface of the second side 46, parallel to and slightly offset from the primary frame member 60, as to form a slot 68 extending along the length of the second frame member 64.

As shown in FIG. 4-6, when the slidable or fixed shelving unit 14 is affixed beneath and in-part behind the multi-level riser 12, the rear surface 18 of the multi-level riser 12 may contact or otherwise engage the outer frame 58. Specifically, the rear surface 18 of the multi-level riser 12 may be received and retained within the slots 66, 68 of the outer frame 58. That is to say that the rear surface 18 of the multi-level riser 12 is generally planar and configured to be slid into the slots 66, 68 until the interior and top 23 of the rear surface 18 of the multi-level riser 12 comes to rest against the top edge 67 of the first side frame member 62 and the top edge 69 of the second side frame member 64. In this configuration the outer frame 58 will provide a support for maintaining the desired relative positioning of the multi-level riser 12 and the slidable or fixed shelving unit 14 when the system 10 is assembled.

Furthermore, the relative position of the outer frame 58, namely along the sides 44, 46 and between the front 40 and rear 42 of the slidable or fixed shelving unit 14, determines the amount of overlap between the slidable or fixed shelving unit 14 and the multi-level riser 12. That is to say, if the outer frame 58 is positioned near the front 40 of the slidable shelving unit 14, then the two components of the system 10 will exhibit decreased overlap; while, if the outer frame 58 is positioned near the rear 42 of the slidable or fixed shelving unit 14, then the two components of the system 10 will exhibit relatively increased overlap. The position of the outer frame 58 relative to the depth of the slidable or fixed shelving unit 14 may be selected to maximize the footprint of the system 10 relative to the size of the available base 36 as defined by the depth of a deli-style refrigerated display case. Additionally, the incline angle of the outer frame 58 relative to the bottom 50 upon which the shelving unit 14 rests will alter the angle of incline of the multi-level riser 12, when the storage system 10 is assembled. In one embodiment, the outer frame 58 extends upwardly from the bottom 50 at an angle of between approximately 50° and 70°, and more preferably between approximately 55° and 65° relative to the bottom 50. Resultantly, the rear 18 of the multi-level riser 12 is raised between approximately 5° and 20° from the base 36 upon which the storage system 10 rests, and more preferably between approximately 7° and 12°.

Turning now to FIGS. 7 and 8, the display and storage system 10 is shown in use in accordance with one embodiment of the present invention. While not illustrated as being positioned within a deli-style display case, FIG. 7 shows the system 10 including the multi-level display riser 12 and slidable or fixed shelving unit 14 both stocked with food products 30 as they would be employed in use within a display case. Specifically, the three shelves 26 of the multi-level riser 12 are shown with forward facing bulk and unopened food products 30 in a display configuration, such that prospective customers can easily view the food products 30. The series of shelves 52 of the slidable shelving unit H are also shown supporting a number of food products 30 that correspond to the forward facing food products 30 but that are accessible from the rear 42 of the slidable or fixed shelving unit 14. In this configuration, the food products 30 that are accessible from the rear 42 of the slidable or fixed shelving unit 14 may be readily accessed for slicing by a grocery store or deli employee without disrupting the food products 30 that are displayed in front of the display and storage system 10. Furthermore, as shown in FIGS. 7 and 8, the lower slidable shelf 52 is elevated above the base 36 upon which the system 10 is supported as to provide additional storage capacity on the area of the base 36 located below the lower slidable shelf 52, without causing interference or contacting the underside of the lower slidable shelf 52. Accordingly, in use the slidable or fixed shelving unit 14 as illustrated, provides for three food product supporting surfaces, thereby greatly increasing the storage capacity of the system 10 and decreasing the overall footprint of the stored products, as compared to the independent use of a multi-level riser 12 in the absence of the integrated slidable or fixed shelving unit 14. Moreover, due to the generally uninterrupted construction of the front 16 of the multi-level riser 12 and the presence of the food products 30 resting thereon, use of the slidable or fixed shelving unit 14 in combination with the multi-level riser in system 10 results in the obstructing the prospective customer's line of sight to the area of the base 36 located underneath and behind multi-level riser 12. This obstructed line of sight provides an improved display esthetic in which the opened and/or partially used food product packages are removed from view.

Although a specific embodiment is illustrated and discussed above, it is understood that the size and shape of the system 10 may vary greatly to accommodate space of the display case in which the system 10 is to be used and the size and shape of perishable food products 30 to be displayed on the system 10. While the figures have illustrated system 10 having a height of approximately between 12 and 30 inches, a width of approximately between 12 and 48 inches and a depth of approximately between 12 and 36 inches, larger or smaller systems 10 are considered well within the scope of the present invention.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

I claim:

1. A food product display and storage system configured for use in a deli-style refrigerated display case, the system comprising:

a display riser comprising a plurality of product support surfaces at a front of the display riser configured to retain food products thereon, wherein the plurality of product support surfaces includes at least a first product support surface at a first height and a second product support surface at a second height greater than the first height, wherein the product support, surfaces extend across a width of the display riser between a first side of the display riser and a second side of the display riser;

wherein the display riser includes a rear surface having an opening and a recess extending inwardly from the opening opposite the front of the display riser, wherein one or more of the product support surfaces overlies the recess toward the front of the display riser; and a shelf unit contained within the recess of the display riser and extending through the opening in the rear surface of the display riser, the shelf unit comprising at least one shelf having an upwardly facing surface configured to retain food products thereon;

wherein the rear surface of the display riser, the shelf unit and the at least one shelf are configured such that a rear portion of the at least one shelf extends rearwardly of the rear surface of the display riser, and are further configured such that an area above the rear portion of the at least one shelf is open and the rear portion of the at least one shelf is visible and accessible from a location rearwardly of the rear surface of the display riser and above the rear portion of the at least one shelf.

2. The system of claim 1, wherein the shelf unit comprises a frame including a pair of spaced apart frame members, wherein the at least one shelf is mounted to the frame between the pair of spaced apart frame members, and wherein the display riser and the shelf unit are secured together via engagement of the display riser with the frame of the shelf unit.

3. The system of claim 2, wherein the at least one shelf comprises a fixed location shelf extending in-part within the recess of the display riser.

4. The system of claim 3, wherein the shelf unit includes the fixed location shelf and a slidable shelf movably secured to the frame for movement between a storage position and an extended position, wherein the slidable shelf is located at a first height and the fixed location shelf is located at a second height greater than the first height.

5. The system of claim 4, wherein the frame is configured to rest on a support surface, and wherein the frame is configured such that the slidable shelf is spaced above the support surface, thereby defining a first storage space within the recess and between the support surface and the slidable shelf.

6. The system of claim 1, wherein the at least one shelf configured to retain food products thereon comprises a first shelf mounted between the pair of spaced apart frame members at a first height and a second shelf mounted between the pair of spaced apart frame members at a second height that is greater than the first height.

7. The system of claim 6, wherein a surface area of the first shelf is greater than a surface area of the second shelf.

8. The system of claim 1, further comprising a label support structure at a rear surface of the at least one shelf.

9. The system of claim 1, wherein the display riser and the shelf unit are formed of a food grade rigid plastic material.

10. A food product display and storage system configured for use in a deli-style refrigerated display case, the system comprising:

a display riser comprising a plurality of product support surfaces at a first side of the riser configured to retain food products thereon, wherein the plurality of product support surfaces includes at least a first product support surface at a first height and a second product support surface at a second height greater than the first height;

the plurality of product support surfaces being disposed within a recess in the display riser accessible at an opening in a second side of the display riser that is opposite the first side; and a shelf unit affixed the second side of the display riser at the opening and extending into the recess, the shelf unit comprising at least one shelf configured to retain food products thereon, wherein the shelf unit further comprises an outwardly extending frame defining a slot, and wherein an edge of the second side of the display riser is disposed within the slot to removably affix the display riser to the shelf unit.

11. The system of claim 10, wherein a bottom edge of the display riser is angled between 10° and 20° relative to a generally horizontal surface that the supports the system, when the edge of the second side of the display riser is disposed within the slot in the outwardly extending frame of the shelf unit.

12. A food product display and storage system configured for use in a deli-style refrigerated display case, the system comprising:

a shelf unit configured to retain food products therein, the shelf unit having:

a slidable shelf located at a first height and movable between a first position and a second position rearward of the first position, a fixed location shelf located at a second height that is greater than the first height, a frame extending outwardly along a first side of the shelf unit and an opposing, second side of the shelf unit, wherein the frame defines a first side slot positioned along the first side of the shelf unit and a second side slot positioned along the second side of the shelf unit, and a display riser comprising:

opposing first and second sides, a front facing surface extending between the first and second sides having a plurality of tiered outwardly exposed product support surfaces configured to retain food products thereon, and a rear facing surface extending between the first and second sides opposite the front facing surface;

an interior recess defined between the first and second sides, front facing surface and rear facing surface; and a void in the rear facing surface defined within an inner edge of the rear facing surface, the void being m communication with the interior recess, wherein a portion of the inner edge is received within the first side slot and second side slot of the frame of the shelf unit.

13. The system of claim 12, wherein at least a portion of the fixed location shelf extends through the void in the rear facing surface of the display riser and into the interior recess.

14. The system of claim 12, wherein at least a portion of the slidable shelf extends through the void in the rear facing surface of the display riser and into the interior recess when the slidable shelf is in the first position.

15. The system of claim 12, wherein in the second position, the slidable shelf extends rearwardly of the void in the rear facing surface of the display riser.

16. The system of claim 12, wherein a bottom edge of the display riser is angled between 10° and 20° relative to a generally horizontal surface that supports the system, when the portion of the inner edge of the rear facing surface of the display riser is received within the first side slot and second side slot of the frame of the shelf unit.

17. A food product display and storage system configured for use in a deli-style refrigerated display case, the system comprising:

a shelf unit configured to retain food products thereon, the shelf unit having, a slidable shelf movable between a first position and a second position rearward of the first position, a generally upwardly extending frame extending outwardly along a first side of the shelf unit and along an opposing second side of the shelf unit, wherein the frame defines a first side slot positioned along the first side of the shelf unit and a second side slot positioned along the second side of the shelf unit;

a display riser having:

opposing first and second sides, a front facing surface extending between the first and second sides having tiered outwardly exposed product support surfaces configured to retain food products thereon, a rear facing surface extending between the first and second sides opposite the front facing surface;

an interior recess defined between the first and second sides, front facing surface and rear facing surface; and a void in the rear facing surface defined within an inner edge of the rear facing surface, the void being in communication with the interior recess, wherein a portion of the inner edge is received within the first side slot and second side slot of the frame of the shelf unit such that at least a portion of the slidable shelf extends through the void in the rear facing surface of the display riser and into the interior recess when the slidable shelf is in the first position.

* * * * *